United States Patent [19]

Chevrollier et al.

[11] Patent Number: 4,968,164

[45] Date of Patent: Nov. 6, 1990

[54] PRINTING ASSEMBLY, ADAPTED FOR REDUCTION OF ITS OPERATIONAL SOUND LEVEL

[75] Inventors: Guy Chevrollier, Frepillon; Olivier Dardenne, Cergy; Jean M. Ciccone, Osny, all of France

[73] Assignee: Societe D'Applications Generales D'Electricite et de Mecanique Sagem, France

[21] Appl. No.: 412,804

[22] Filed: Sep. 27, 1989

Related U.S. Application Data

[63] Continuation-in-part of Ser. No. 215,763, Jul. 6, 1988.

[30] Foreign Application Priority Data

Jul. 6, 1987 [FR] France ..... 87 09550

[51] Int. Cl.[5] ..... B41J 15/16

[52] U.S. Cl. ..... 400/618; 400/617; 400/689

[58] Field of Search ..... 400/617, 618, 636, 689; 271/270; 226/29, 38, 39, 40, 42, 195

[56] References Cited

U.S. PATENT DOCUMENTS

| | | | |
|---|---|---|---|
| 2,390,554 | 12/1945 | Plum, II | 400/617 |
| 4,186,893 | 2/1980 | Kolosou et al. | 226/195 |
| 4,812,065 | 3/1989 | Simogawara | 400/629 |

FOREIGN PATENT DOCUMENTS

| | | | |
|---|---|---|---|
| 0039980 | 3/1982 | Japan | 400/618 |
| 58-89387 | 8/1983 | Japan . | |
| 0194587 | 11/1983 | Japan | 400/617 |
| 0038189 | 2/1985 | Japan | 400/617 |

*Primary Examiner*—Edgar S. Burr
*Assistant Examiner*—Ren Yan
*Attorney, Agent, or Firm*—Larson and Taylor

[57] ABSTRACT

A printing assembly which is adapted for printing on a print medium in a form of a sheet or tape includes a printing cylinder on which is wound and urged the print medium during a printing operation. A printing device prints on the print medium and urges it against the printing cylinder. An advancing device upstream of the printing device serves to advance the print medium and a tensioning device downstream of the printing devices tightens the print medium against the printing cylinder. The tensioning device includes two contra-rotating rollers having substantially smooth outer surfaces in contact from opposite sides of the print medium which allow sliding at the contacting surfaces and which provide for tensioning of the print medium on the print cylinder. The rollers are of the same diameter and are both motorpowered and driven at the same rotational velocity, which rotational velocity is greater than the advance velocity of the advancing device. The tensioning device also includes a mechanism for pulling the rollers elastically towards each other with forces which are substantially constant and identical.

6 Claims, 2 Drawing Sheets

PRINTING ASSEMBLY, ADAPTED FOR REDUCTION OF ITS OPERATIONAL SOUND LEVEL

This application is a continuation-in-part, of application Ser. No. 215,763 filed July 6, 1988.

The present invention concerns improvements to be applied to printing assemblies which are adapted to print on a print medium in the form of a sheet or a tape, for the purpose of reducing the sound level while the printer is in operation, and to accomplish this whatever the type of print medium being used.

Figure 1:
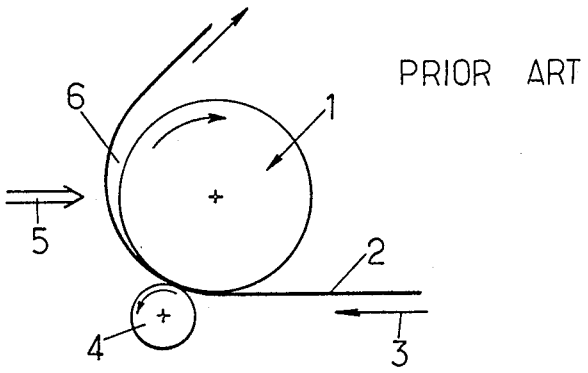

As shown in FIG. 1 of the attached drawing (on which are shown very diagrammatically only the elements of a printing assembly which are directly concerned with the scope of the invention), a printing assembly of the type concerned by of the invention comprises particularly a printing cylinder 1 onto which is partially wound a sheet or a tape 2 forming a print medium. The forward movement or advance (arrow 3) of this sheet or tape forming a print medium is caused by the rotation of a drive roller 4 driven by powered means (not shown) and urging the sheet or tape against cylinder 1, forming a capstan; drive roller 4 is situated up stream (in the direction of advance of sheet or tape 2) the printing means (shown diagrammatically by arrow 5).

One significant source of noise, in the course of the operation of such a printing assembly, is what occurs in the area of printing on the print medium. In fact, the sheet or tape 2 forming the print medium, when brought up facing printing means 5, only poorly fits the contour of printing cylinder 1 and is not applied with a perfect fit against the surface of said cylinder, despite the presence of lateral guides (not shown). Because of this, a wedge of air 6 exists between sheet or tape 2 and the surface of cylinder 1. When the printing means 5 (hammers or needles, for instance) is projected against the surface of sheet or tape 2 forming the print medium, said sheet or tape is thrust roughly and forcefully against the surface of printing cylinder 1. Under these conditions, the noise generated by the impact of the printing means on the surface of the sheet or tape which is applied roughly and forcefully against the surface of the printing cylinder is preceded by the noise of impact of the printing means on the sheet or tape itself; then this sheet or tape which at this instant is not in engagement with the surface of the cylinder, and which has a relative natural rigidity, is placed in vibration as a result of the shock of impact and, acting as a microphone diaphragm, amplifies the vibration and generates considerable noise.

This problem further increases in the case wherein the print medium is constituted of a bundle of sheets of print medium (manifold paper) because, if this bundle is not tightened, the sheets which constitute it have a tendency to separate locally from each other and layers of air are formed between the sheets, which are then also set in vibration, at these local points, under the impact of the printing means striking the top sheet; the noise level thus generated is found to be still further increased, as compared with the case of a print medium constituted of one single sheet, because of the presence of a multiplicity of sheets. To avoid this drawback, it is necessary that the print medium be firmly applied against the printing cylinder during the printing steps.

To assure sufficient tension, it is already known to turn to use of a rolling mill type of arrangement, constituted of two contra-rotating rollers situated respectively on both sides of the print medium and turning in counter-rotation to one another while at the same time gripping said print medium.

One example of such an arrangement is provided in the abstract of Japanese patent application 58-89387 (vol. 7, No. 187, 16 Aug. 1983) which however also presents the drawback that only one of the two rollers of the rolling mill arrangement is motor-powered; in the case of a manifold print medium, only the external sheet in contact with the motor-powered roller is suitably effected, while the other sheets are being poorly transmitted or are not transmitted at all, and this results in destruction of the bundling of the manifold print medium and blocking of the printing assembly.

Besides, the rollers rotate with a peripheral velocity which is greater than the advance velocity of the print medium; because of the fact that at least one of the rollers is rubber or is coated with rubber, the friction being exerted on the corresponding sheet is extremely high and there is great risk of tearing the sheet.

Moreover, the contact of the rubber surface of the roller on the sheet leaves black marks on the sheet, of which the significance accumulates with wear and with degradation of the rubber surface, and it is significantly desirable to avoid this phenomenon.

Finally, this known device is not adapted to cooperate in all circumstances with any type of print medium of any of many different thicknesses, particularly with single sheets as well as fan-fold print mediums, which considerably reduces its range of usefulness.

Generally speaking, such a structure appears to be inappropriate to assure the effective, safe and reliable operation required without degradation or damage of the print medium.

In addition, U.S. Pat. No. 2,390,554, particularly in FIG. 1, shows two different arrangements of rolling mills with two rollers 31, 32 and 41, 42. However, in both of the cases it has to do with arrangements of the rolling mill type for transmission of the print medium, and all of these rollers are coated with rubber. It is not provided in this case that these rollers turn at peripheral velocities greater than the advance velocity of the print medium.

Generally speaking, the rolling mill arrangements with rubber rollers are widely used in printers to assure the transmission of the paper, but these devices are not adapted to assure efficient placement of the print medium under tension without damage to the print medium.

Thus, the main object of the invention is to provide a simple mechanical device which is specifically adapted to assure efficacious tightening of the print medium when it is placed on the printing cylinder, without destruction or damage to said print medium, and which can cooperate with print mediums of various thicknesses (particularly, either a single sheet or a manifold sheet), in such a manner as to decrease the noise being generated in the course of the printing.

For these purposes, in a printing assembly which is adapted to print on a print medium in the form of a sheet or tape and comprising:

a printing cylinder onto which is wound and on which is supported the print medium in the course of the printing steps, a printing means to print on the print medium and to urge it on the printing cylinder, and advance means of forward movement situated up the line from the print head (in the direction of movement of the print medium) and adapted to move the print medium, it is provided, according to the invention, that this printing assembly also down-stream, the printing means down the line from the print head (in the direction of movement of the print medium), means for tightening of the print medium under tension, comprising an assembly of two contra-rotating rollers which both have perfectly smooth surfaces and which exert a slight friction on the print medium in such a manner as to be capable of sliding on the respective surfaces of the print medium, which are both motor-powered, which are of identical diameters, which are driven at the same rotational velocity with a peripheral velocity greater than the advance velocity communicated to the print medium by said advance means, and which are pulled back elastically toward one another, on either side of the print medium, with forces which are respectively substantially constant and are identical for the two rollers.

Thus, by virtue of the presence of two motor-powered rollers turning at the same velocity, the two surfaces of the print medium are placed simultaneously and symmetrically in traction, with identical velocities, without generating any disturbances in the advance of this print medium. That is of very particular and primary importance for the manifold paper of which the two side (external) sheets of the bundle are transmitted by the action of the motor-powered rollers on their respective external surfaces; the other sheets (internal sheets) are then also transmitted by friction and without any problem because of the high friction level that the sheets of the print medium (generally, of paper) exert between them.

Moreover, the fact that the roller surfaces are smooth and have a quite low friction coefficient relative to the print medium assures a regular or uniform sliding or creeping (slipping) of the rollers on the surfaces of the print medium; thus the drawbacks inherent in the presence of a "hooking" material such as rubber are avoided, and there is no risk whatsoever of tearing or deterioration of the print medium. Here it will be noted that, while various materials can be used to constitute the rollers required by the invention, it is nonetheless very advantageous to make use of metal rollers or else rollers with metal peripheries, for instance of steel, of which the surface is polished, because it is in this case that the characteristics which are sought (low friction coefficient and smooth surface) are the best.

Finally, when the material used for the roller surfaces has a smooth surface, and particularly if it is polished metal such as steel, the print medium is left intact and the black marks caused by the rubber rollers of the aforementioned roller mill arrangement are avoided.

By virtue of the assembly of the aforementioned features, the assurance is secured that the sheet or tape forming the print medium is applied permanently to the surface of the printing cylinder and the aforementioned wedge of air no longer exists; the sheet or tape can no longer be placed in vibration as a result of the impact of the printing means, and the elimination of this source of noise procures a notable diminution of the sound level in the course of operation of the printing assembly, a diminution which can attain on the order of 2 to 3 dB.

In one preferred embodiment, the advance means of the print medium comprises at least one advance roller and the velocity of the rotary drive of the tightening rollers is greater by 1 to 3% than the rotary velocity of the advance roller.

In one preferred embodiment the two rollers are coupled in pairs in rotation by a movement transmission device comprising two driving wheels which are coupled in rotation respectively with these rollers and an elastically deformable endless strap wound on these driving wheels; it is desirable that this endless strap be a helical spring in the form of an integral loop.

Figure 2:
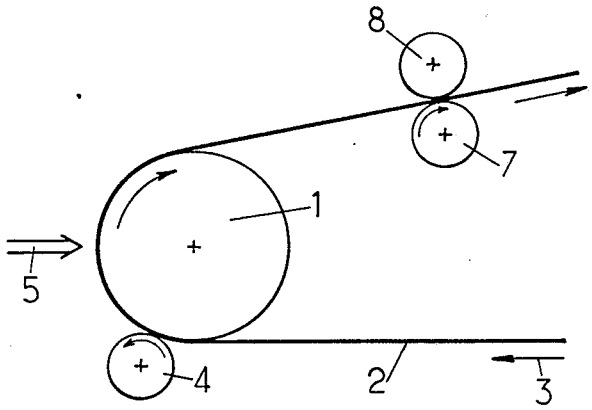
Figure 3:
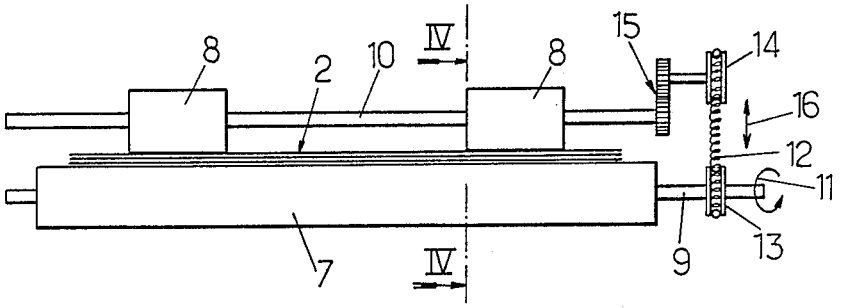
Figure 4:
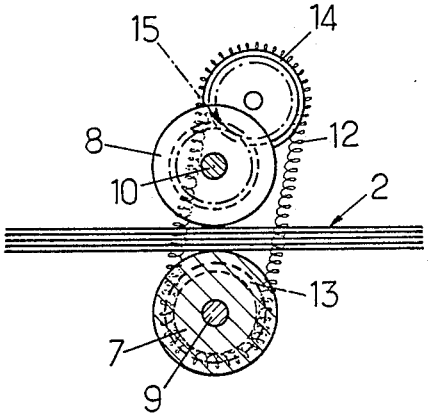

The invention will be better understood upon reading the following detailed description of one preferred embodiment provided solely as an illustrative example; in the drawings:

FIG. 2 shows an arrangement of a printing assembly according to the invention in very diagrammatic representation, and FIGS. 3 and 4 represent diagrammatically, but also more completely, the arrangement of the tension rollers appearing in FIG. 2.

In FIG. 2, which corresponds to FIG. 1 relating to the state of the art, the same elements are designated by the same numeric references.

According to the invention, supplementary drive means for the sheet or tape forming the print medium 2 are placed downstream the printing means 5, in such a manner that this medium 2 is applied permanently against the surface of printing cylinder 1 facing printing means 5. As shown, the sheet or tape 2 is made to pass into a tensioning device comprising two rollers 7 and 8 both being driven contra-rotatively by motor means (not shown); rollers 7 and 8 move at a rotary velocity greater than that of advance roller 4; the difference between rotary velocities of rollers 7 and 8 and roller 4 must be sufficient so that sheet or tape 2 remains permanently applied against the surface of cylinder 1, but the force must nonetheless not be excessive, because tearing of sheet or tape 2 is to be avoided, and the force must be applied in such a manner that the advance (principally a step by step advance for line by line printing) of the print medium controlled by advance roller 4 is not disturbed by the traction exerted by rollers 7 and 8. An overspeed of rollers 7 and 8 on the order of 1 to 3% in relation to the velocity of roller 4 seems to be the most appropriate velocity.

So that the print medium 2 is driven in a uniform manner whatever its type (duplicating fan-fold paper, for example), the two rollers 7 and 8 are of the same diameter and are driven at the same velocity, in such a manner that they exert substantially equal traction forces of on the two external surfaces of said print medium 2.

For the correct longitudinal guide of the print medium, one of the rollers, for example lower roller 7, is of one single unit and extends at least over the entire width of the print medium 2, while the other roller 8 is constituted of two support rollers which are separated from one another and are set off toward the edges of the print medium, as is shown in FIG. 3.

So that the tensioning arrangement which is thus constituted can function reliably without blocking the assembly and without tearing the print medium, it is necessary that rollers 7, 8 be able to turn with some loose sliding or creep (slipping) on the print medium surfaces. For this purpose, the two rollers must have perfectly smooth surfaces and must exert a slight friction on the surfaces of the print medium. The surfaces of the rollers are advantageously metal, for example steel, and are perfectly polished, either because the rollers are entirely metallic, or because they are equipped with an external metallic tubular casing.

Finally, so that the device accepts print mediums of various different thicknesses (single sheet or fan-fold paper), it is necessary that the two rollers 7 and 8 be separable from one another while also being drawn back elastically toward one other, and also, simultaneously, their being set in rotation is effected from one single transmission, for simplification of the structural assembly. For these purposes, rollers 7, 8 are mounted on two axes respectively 9 and 10, of which the one is set in rotation (arrow 11) by not shown means. The rotary coupling of the two shafts is provided with an endless strap 12 being wound on a driving wheel 13 fitted onto the motor shaft 9, and on a drived wheel 14 fitted onto an intermediate shaft coupled for instance by gearwheel 15 to shaft 10 so as to obtain the necessary inversion of the direction of rotation In order to allow for the reciprocal displacement of the two shafts 9 and 10 along with elastic pulling back of these two shafts toward one another (double arrow 16), the endless strap is constituted for instance of a helical spring closed in an integral connection to form an elastically deformable loop; driving wheels 13 and 14 can be constituted of a material or can posses a coating of a material which offers a high friction coefficient in contact with the endless strap 12 so as to prohibit the sliding of the endless strap. The endless strap can also be an elastomeric belt. As is obvious and also as a result of the preceding teaching, the invention is not in any way limited to those of the modes of application and realization which have been particularly described; on the contrary, it includes in its scope all variations and modifications of embodiment.

We claim:

1. Printing assembly which is adapted for printing on a print medium in a form of a sheet or tape comprising:

a printing cylinder on which is wound and urged said print medium during a printing operation;

printing means to print on said print medium and to urge it against the printing cylinder;

advance means upstream of said printing means to advance said print medium;

tensioning means downstream of said printing means for tightening the print medium against said printing cylinder, comprising:

two contra-rotating rollers having substantially smooth outer surfaces in contact from opposite sides of said print medium, allowing sliding at said, contacting surfaces and providing for tensioning of the print medium on said print cylinder; said rollers being of the same diameter and both motor-powered and driven at the same rotational velocity, said rotational velocity being greater than the advance velocity of said advance means; and means for pulling said rollers elastically towards each other with substantially constant and identical forces, respectively.

2. Printing assembly as in claim 1, wherein the rollers of said tensioning means are metal and have polished surfaces.

3. Printing assembly as in claim 1, wherein the rollers of said tensioning means each have an external polished metal surface.

4. Printing assembly as in claim 1, wherein said advance means comprises at least one advance roller and the rotational velocity of said tensioning rollers is 1 to 3% greater than that of said advance roller.

5. Printing assembly as in claim 1, wherein said tensioning rollers are coupled together by a rotation transmission device comprising two driving rollers which are connected together by an elastically deformable endless strap wound around their peripheries and rotate respectively with said tensioning rollers.

6. Printing assembly as in claim 5, wherein said endless strap is a helical spring connected in a loop.

* * * * *